US005269473A

United States Patent [19]

Strohmeyer et al.

[11] Patent Number: 5,269,473

[45] Date of Patent: Dec. 14, 1993

[54] SUPPORT STRUCTURE FOR A PAPER SHREDDER

[75] Inventors: Willi Strohmeyer; Knut Bliesener, both of Hanover, Fed. Rep. of Germany

[73] Assignee: Geha-Werke GmbH, Hanover, Fed. Rep. of Germany

[21] Appl. No.: 850,667

[22] Filed: Mar. 13, 1992

[30] Foreign Application Priority Data

Mar. 13, 1991 [DE] Fed. Rep. of Germany ..... 4107922

[51] Int. Cl.[5] ..... B65F 1/08

[52] U.S. Cl. ..... 241/100; 220/671; 220/401; 220/908; 220/668; 248/146

[58] Field of Search ..... 248/907, 146; 241/100; 220/401, 408, 410, 668, 675, 671, 669, 23.83, 23.86, 737, 908, 914, 565

[56] References Cited

U.S. PATENT DOCUMENTS

| | | | |
|---|---|---|---|
| 1,230,672 | 6/1917 | Christian | 241/100 |
| 1,814,803 | 7/1931 | Herzberger | 220/908 |
| 2,620,988 | 12/1952 | Tellier | 241/100 |
| 3,305,414 | 2/1967 | Hodgson | 241/100 |
| 3,547,273 | 12/1970 | Bompart | 248/146 |
| 4,739,894 | 4/1988 | Pender | 220/908 |
| 4,911,325 | 3/1990 | DeGiulio | 220/908 |
| 5,033,637 | 7/1991 | Webb | 220/565 |
| 5,050,755 | 9/1991 | Strawder | 220/334 |
| 5,139,299 | 8/1992 | Smith | 248/907 |

FOREIGN PATENT DOCUMENTS

| | | | |
|---|---|---|---|
| 2249251 | 9/1973 | Fed. Rep. of Germany | 241/100 |
| 3922313 | 1/1991 | Fed. Rep. of Germany | 241/100 |
| 2576291 | 7/1986 | France . | |
| 177891 | 9/1935 | Switzerland . | |

*Primary Examiner*—Allan N. Shoap
*Assistant Examiner*—S. Castellano
*Attorney, Agent, or Firm*—Herbert Dubno; Yuri Kateshov

[57] ABSTRACT

A stand for a shredder has its frame members fully accommodated in recesses open to the rear of a paper collector so that the stand is not visible from the front or sides. The paper shredder-cutter unit is mounted on the stand only so that the collector can be removed and does not have a supporting function. The appearance of the integrated assembly of paper shredder, collector and stand is similar to that of a cabinet-type paper shredder.

13 Claims, 6 Drawing Sheets

SUPPORT STRUCTURE FOR A PAPER SHREDDER

Field of the Invention

Our present invention relates to a support structure for a paper shredder and, more particularly, to a structure, including a shredded-paper collector or container, upon which a paper shredder can be mounted, the paper shredder comprising, in an appropriate housing, a motor-driven cutter unit capable of subdividing paper or other information carriers introduced through an inlet slot or mouth, into strips or other pieces.

Basically, such a support structure is comprised of a frame and a paper collector or paper-receiving container which is removably received on the frame so that it can collect the comminuted paper for disposal.

BACKGROUND OF THE INVENTION

A paper shredder having a support structure which is comprised of a frame and a paper collector is described in German Patent 22 09 431. In this system, the paper shredder rests upon a tubular frame support into which the paper collector is inserted and is received so as to provide at least part of the supporting function.

The support frame is comprised of two closed tubes located along the sides of the shredder. The paper collector is inserted between the two halves of the support frame.

A drawback of this system is that the frame members lie outwardly of the collector and thus do not interact with the collector in an optimum manner. The appearance of the unit is also a disadvantage.

There are systems which mount a shredder directly upon the paper basket. These systems also do not form a coherent visual unit, provide surfaces which may catch upon the user and which may not provide adequate support. An important disadvantage of this system, moreover, is that the shredder must be lifted from the basket whenever the basket must be emptied. The consequence is a probability that paper particles and residues may spread through the room.

OBJECTS OF THE INVENTION

It is, therefore, the principal object of the present invention to provide a support for a paper shredder and, indeed, a paper shredder in which the cutter unit is mounted upon a support which will integrate the paper collector, the support frame and the cutter unit or shredder itself both optically and structurally so that, from the point of view of appearance at least, the collector will function as a cabinet for the paper shredder although it can be removed therefrom for emptying and does not require lifting of the shredder unit from the support.

Another object of the invention is to provide an economically constructed and marketable paper shredder which has the optical unity of a cabinet-type paper shredder without the added cost thereof and without complexities involved in emptying such paper shredder.

Still another object of the present invention is to provide a support structure for a paper shredder whereby earlier drawbacks are avoided.

SUMMARY OF THE INVENTION

These objects and others which will become apparent hereinafter are attained, in accordance with the invention, in a support structure for a paper shredder which comprises:

a frame comprising a substantially vertical back section formed from at least one upright, a substantially horizontal upper section for receiving a cutter unit of a paper shredder and mounted on the back section and a base section affixed to a lower portion of the back section and angled from the upright; and a shredded-paper collector for receiving shredded paper from the unit, the collector being upwardly open, fitting beneath the unit and formed with rearwardly open recesses for the sections whereby, upon insertion of the collector beneath the unit, the collector receives the frame and shields the frame substantially from view.

According to a feature of the invention, the members of the frame are angled metal strip, preferably so-called metal angles or channels or equivalent structural shapes. Alternatively, members forming the frame may be tube members and the frame may have a tubular construction.

According to another feature of the invention, the paper collector is a one-piece injection-molded plastic container, the upper end of which has a width corresponding to the width of the paper shredder itself so that the lateral edges of the mouth of the collector are substantially at the end walls of the housing of the shredder. The lateral and front walls of the collector can converge downwardly and inwardly, and, if desired, the rear wall may be vertical.

The support frame of the invention may, therefore, have a substantially vertical section from which the upper and lower sections angle forwardly, thereby creating a very simple frame which can be fabricated in a highly economical manner.

Since the frame has a much smaller width than the paper collector and the shredder itself and paper collector is formed at its rear with upon recesses accommodating the section of the frame, the frame can be practically fully concealed from view, except as seen from the rear. The result is that the assembly has the appearance of a cabinet for the shredder and can be used with greater cleanliness. Since the frame is substantially covered by the collector, it does not detract from the appearance of the apparatus in an office environment.

Both the formation of the frame members as metal structural shapes and especially angles or from tubing can be realized simply and inexpensively at low material cost.

When the frame members are bent sheet metal parts, it is advantageous to provide angled flanges which increase the stability of these structural shapes. The horizontal outwardly bent portions of the lower section or base can form standing surfaces for the frame which can increase the static stability of the shredder.

The paper collector need not be designed with structural support in mind and hence its shape can be more freely selected than has hitherto been the case. In a preferred embodiment, the paper collector is injection molded from synthetic resin, thereby minimizing the cost. Such injection molding, moreover, enables the rearwardly-open recesses of the collector to be formed economically and simply to accommodate the sections of the frame. The inclined walls of the collector facilitate emptying thereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
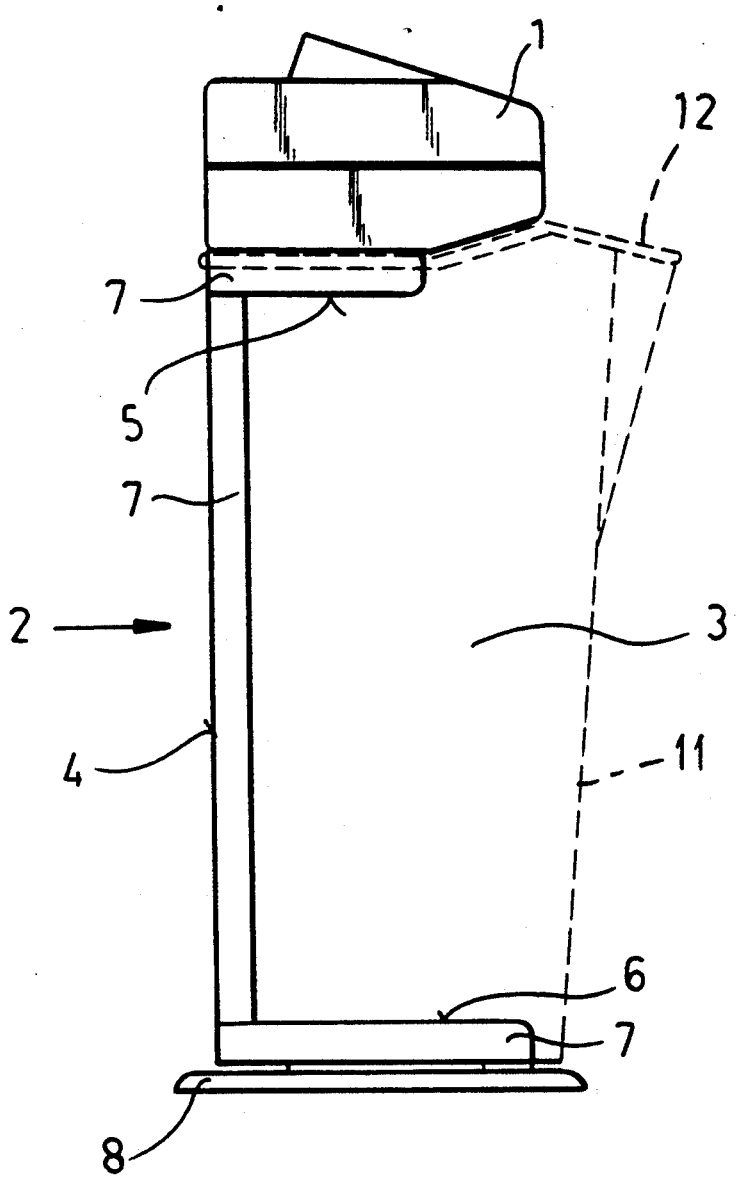
FIG. 1 is a side elevational view of a paper shredder according to the invention with the collector removed.

In the drawing we have shown a paper shredder 1 which is mounted on a support structure comprised of a frame 2 and a paper collecting receptacle 3.

From FIG. 1 it will be apparent that the frame 2, made of bent sheet steel, for example, e.g. steel angles, can comprise a vertically-oriented rear section 4, a substantially horizontal upper section 5 angled forwardly from the rear section and secured thereto to form a support for the shredder or cutter unit in its housing, and a substantially horizontal bottom section 6 forming a stand for the frame.

Figure 3:
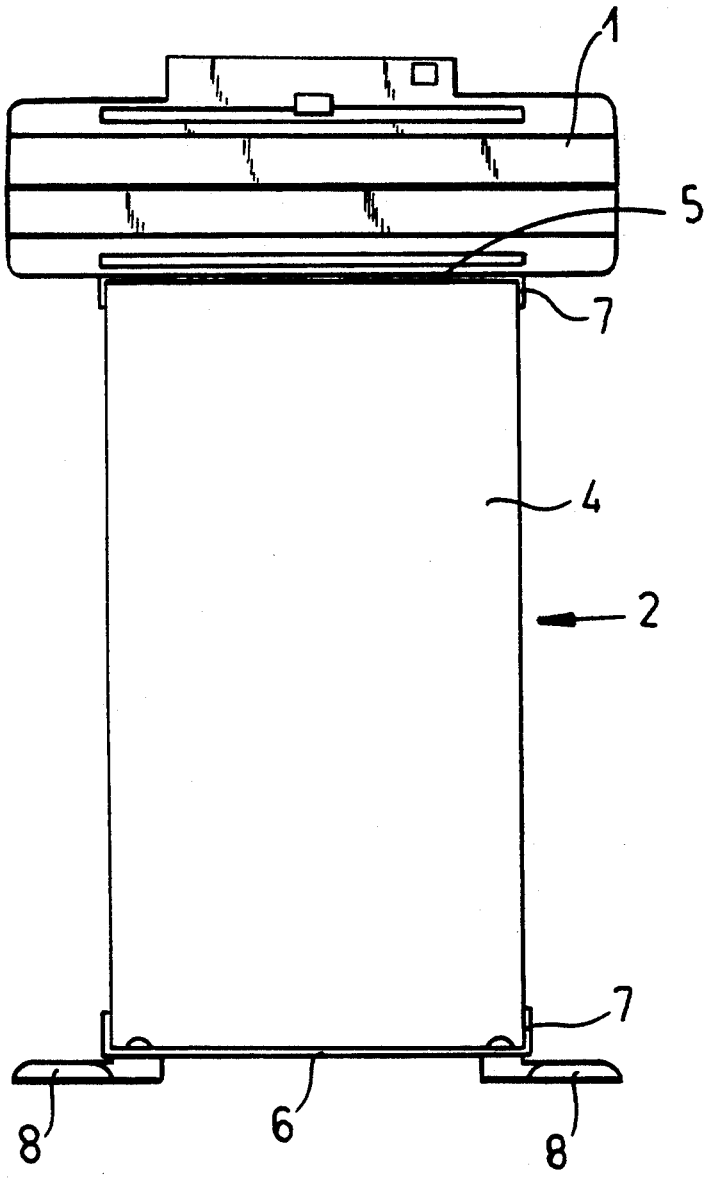
FIG. 3 is a front elevational view of the paper shredder of FIG. 1 with the paper collector removed.

The sections 4, 5 and 6 of the frame 2 have angled edge surfaces or flanges 7 to increase the stability of the frame or stand. The flanges 7 are also visible in FIG. 3 of the drawing.

The horizontal bottom section 6 of the frame 2 is provided with pedestal surfaces or feet 8 which can be downwardly turned (FIG. 3) to increase the stability of the stand against lateral forces applied to the shredder 1.

Figure 2:
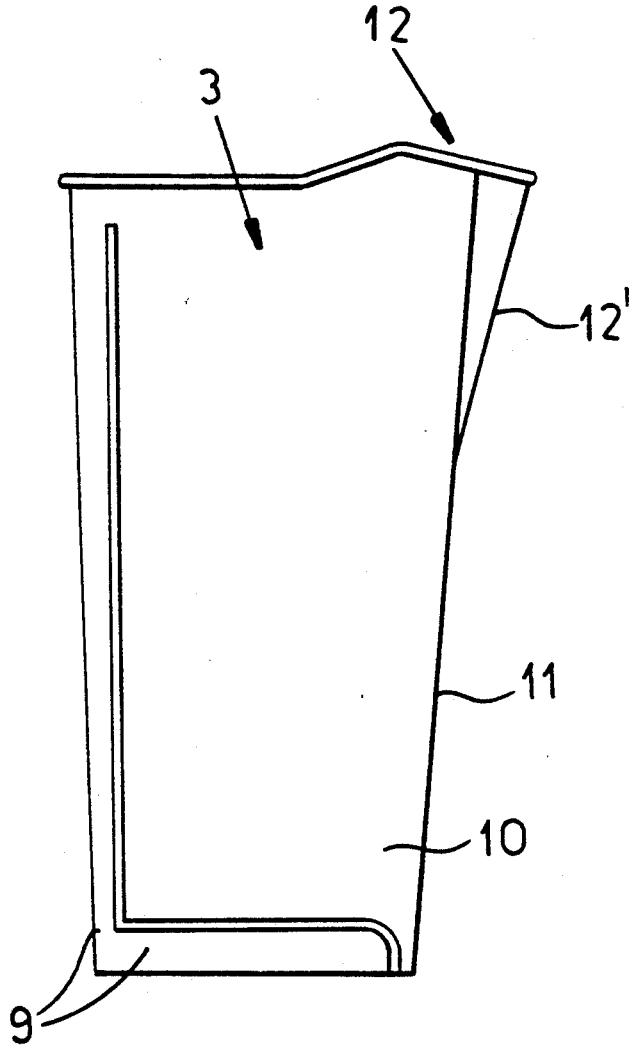
FIG. 2 is a side elevational view of a paper collector for use with the shredder of FIG. 1.

From FIG. 2 of the drawing, it will be apparent that a paper collector 3, which is receivable in and on the stand 2 can have its rear provided with rearwardly open recesses 9. The recesses 9 are injection molded in the one-piece container composed of synthetic resin or plastic material.

From the side view of FIG. 1, in which the collector 3 is shown in broken lines, it will be apparent that the sections 4–6 of the stand 2 engage in the recesses so that the recesses receive the stand and the stand is from the front and the sides, concealed within the container 3.

Figure 4:
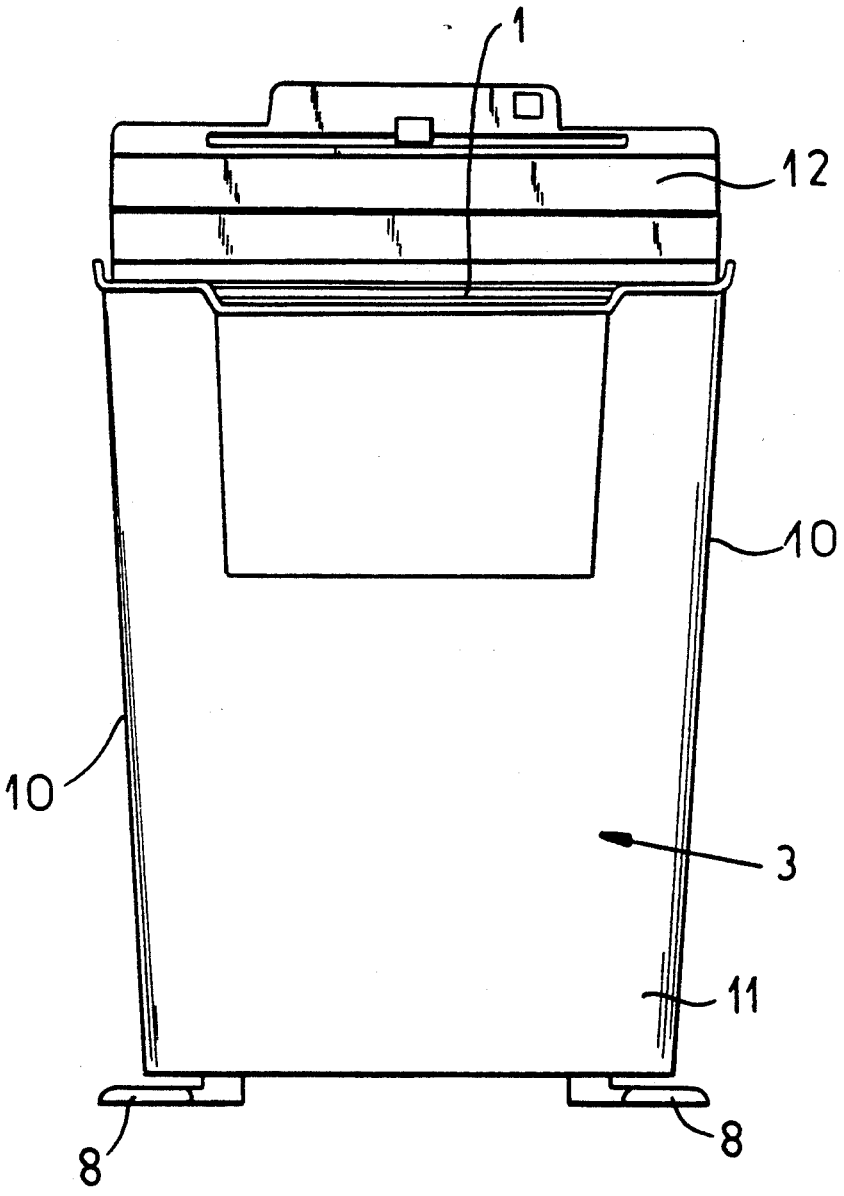
FIG. 4 is a front elevational view of a paper shredder according to the invention with the paper collector in place.

From the front view of FIG. 4, with the collector 3 in place, the frame or stand 2 is completely invisible.

It is also possible to impart to the collector 3 a configuration that allows it to completely conceal the stand 2 from both sides. Only pedestal surfaces 8 project beyond the collector 3 (see FIG. 4).

The side walls 10 of the collector 3 are inclined inwardly and downwardly as is the front wall 11 of the collector 3 (compare FIGS. 2 and 4).

The front wall 11 may be provided with a forwardly-projecting pocket 12' formed with an opening 12 adapted to receive waste paper which is to be discarded without shredding.

Since the shredder cutter unit 1 is fully supported by the stand 2, the paper collector 3 can be inserted into and over the stand 2 without having to assume any supporting function. Thus the shredder need not be lifted away when the collector is removed for emptying. Since the stand 2 is completely invisible from the front and sides, the apparatus has a solid compact configuration in which the collector 3 appears to form a cabinet on which the shredder 2 is supported.

Figure 5:
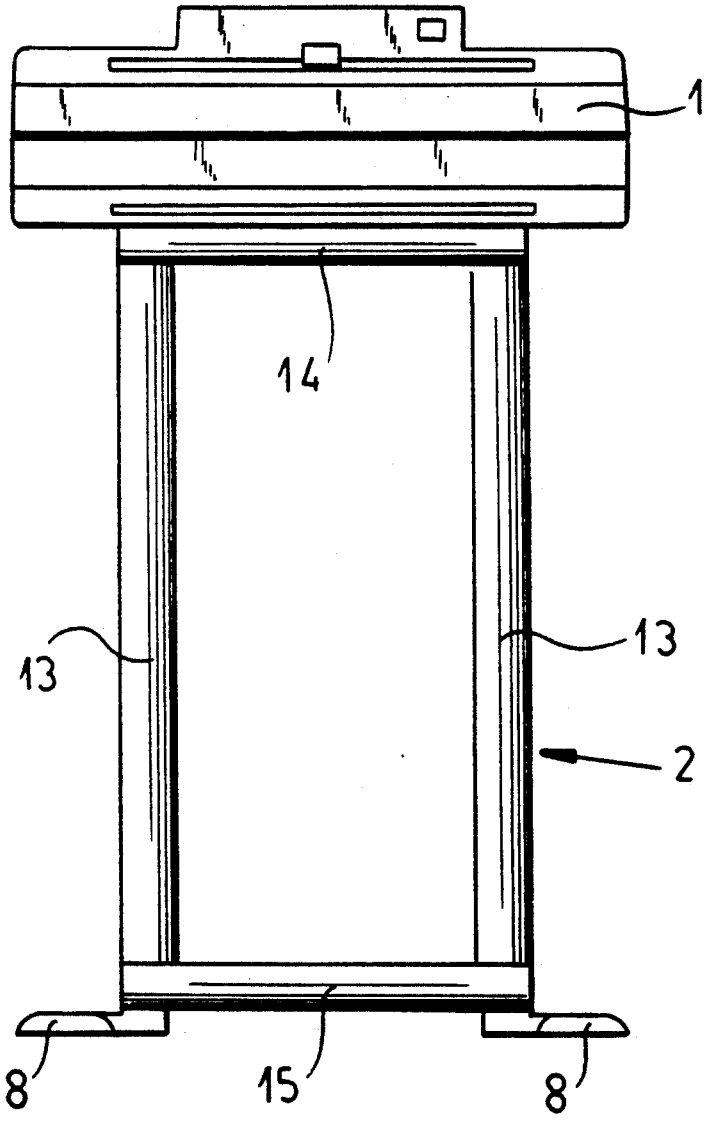
FIG. 5 is a view similar to FIG. 3 and illustrating another embodiment of the invention.

FIG. 5 shows a embodiment of the invention in which the n stand or frame 2 is of tubular construction and comprises an upright formed by limbs 13, a substantially horizontally-angled upper section 14 and a horizontally-angled lower section 15. The upper section 14 here also serves as a support for the shredder 1.

In addition, the lower section 15 is provided with pedestal members or feet 8 which project laterally outwardly. The recesses 9 open at the rear of the paper collector of this embodiment and are also configured to completely receive the sections 13, 14 and 15 of the stand. When the collector 3 is in place, therefore, this frame is also not visible.

The stand 2 and the collector 3 are separate parts of which only the stand 2 actually supports the shredder 1 to receive the comminuted paper therefrom through the open mouth of the collector 3 underlying the shredder outlet. The unit 2, 3 can be made available separately from the shredder 1 and can accommodate a waste basket shredder. The apparatus is particularly user-friendly and of esthetic appearance.

Figure 6:
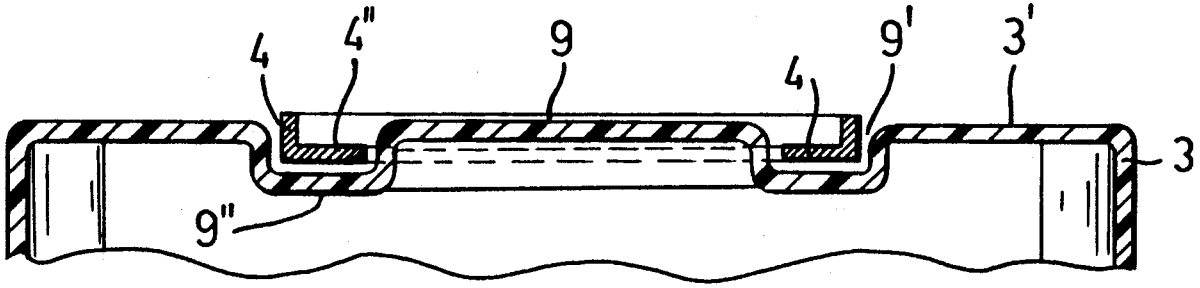
FIG. 6 is a detail view in section showing the recesses of a collector accommodating frame members according to the invention.
Figure 8:
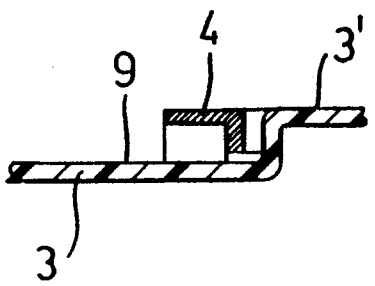
FIG. 8 is a cross sectional view showing another configuration of a collector recess accommodating frame members.
Figure 7:
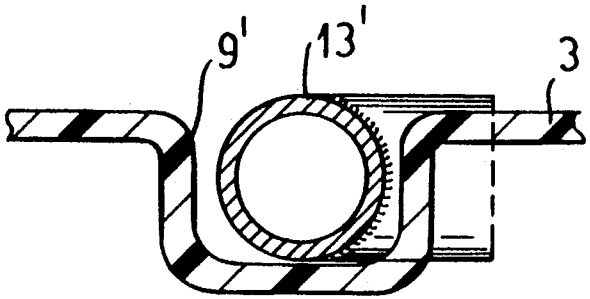
FIG. 7 is a detail view of a larger scale showing a tubular frame member accommodated in the recesses of the container.

As can be seen from a comparison of FIGS. 6 and 8, the recesses 9' or 9 can form pockets in which the individual frame members are received or a wide pocket in which the entire section is received. The pockets 9' can even accommodate tubular members 13' of the stand. Each of the recesses has a surface 9'' which is juxtaposed with a respective portion of the upright 4'' over a full height of cutter.

FIG. 8 shows the back portion 4 of the frame lying flush with the back side 3' of the container.

We claim:

1. A paper shredder comprising:

a frame comprising a substantially vertical back section formed from at least one upright, a substantially horizontal upper section mounted on said back section and connected thereto only at a back of the upper section and a base section affixed to a lower portion of said back section and angled from said upright;

a cutter unit mounted on said upper section; and a shredded-paper collector removably inserted in said frame for receiving shredded paper from said unit, said collector being upwardly open and formed with:

a pair of side walls extending a full height of said frame between said base and upper sections, a rear wall bridging said side walls and provided with at least one recess receiving said back section upon insertion of said collector on said frame in an insertion direction, said recess being vertical and spaced inwardly from said side walls and open rearwardly in said direction to receive said upright overt the full height of the upright and to shield said upright from view, said cutter unit being supported exclusively at a rear of said cutter unit and said frame.

2. The paper shredder defined in claim 1 wherein said sections are formed from bent metal strip.

3. The paper shredder defined in claim 2 wherein said sections are formed from metal angles.

4. The paper shredder defined in claim 1 wherein said sections are formed from tubes.

5. The paper shredder defined in claim 1 wherein said base section is formed with a pair of horizontally outwardly angled lower members forming standing surfaces for the support.

6. The paper shredder defined in claim 1 wherein said collector is an injection-molded container composed of a synthetic resin material.

7. The paper shredder defined in claim 6 wherein said container is formed in one piece.

8. The paper shredder defined in claim 1 wherein said collector has a width at its upper end substantially equal to a width of said shredder and said shredder overhangs said upper section of said frame.

9. The paper shredder defined in claim 8 wherein said collector has said side walls which are inclined downwardly toward one another.

10. The paper shredder defined in claim 9 wherein said collector has a front wall inclined downwardly and inwardly.

11. The shredder defined in claim 11 wherein said at least one recess has two recesses.

12. The shredder defined in claim 10 wherein said back section of the frame is formed with two uprights each received in one of said two recesses.

13. The shredder defined in claim 1 wherein said back section of said frame and said rear wall of said container are flush.

* * * * *